US005799355A

United States Patent [19]

Burch et al.

[11] Patent Number: 5,799,355

[45] Date of Patent: Sep. 1, 1998

[54] PADDED TOOTHBRUSH

[76] Inventors: Aileen Burch, R.D. 2 Box 2092; Cynthia M. Newport, R.D. 2 Box 2087F, both of Stroudsburg, Pa. 18360

[21] Appl. No.: 808,800

[22] Filed: Feb. 28, 1997

[51] Int. Cl.[6] ..... A46B 9/04; A46B 17/08

[52] U.S. Cl. ..... 15/167.1; 15/246

[58] Field of Search ..... 15/110, 167.1, 15/246

[56] References Cited

U.S. PATENT DOCUMENTS

| | | | |
|---|---|---|---|
| 1,251,250 | 12/1917 | Libby | 15/110 |
| 1,993,662 | 3/1935 | Green | 15/110 |
| 4,628,564 | 12/1986 | Youssef | 15/110 |
| 5,325,560 | 7/1994 | Pavone | 15/167.1 |
| 5,373,602 | 12/1994 | Bang | 15/110 |
| 5,517,711 | 5/1996 | Yoo | 15/110 |

FOREIGN PATENT DOCUMENTS

| | | | |
|---|---|---|---|
| 904687 | 2/1954 | Germany | 15/110 |
| 3628722 | 2/1988 | Germany | 15/167.1 |

*Primary Examiner*—Randall E. Chin

[57] ABSTRACT

A new Padded Toothbrush for providing a safer and more comfortable toothbrush. The inventive device includes an elongated member including a handle at one end and a head at an opposite end, wherein a plurality of bristles protrude upward from the head and a protective pad is disposed around the sides of the head and on the back of the head so as to protect a user's teeth, gums, and inner mouth from contact with the head while brushing. In addition to protecting a user's teeth, gums, and inner mouth while brushing, the protective pad can be used for buffing and polishing teeth.

1 Claim, 3 Drawing Sheets

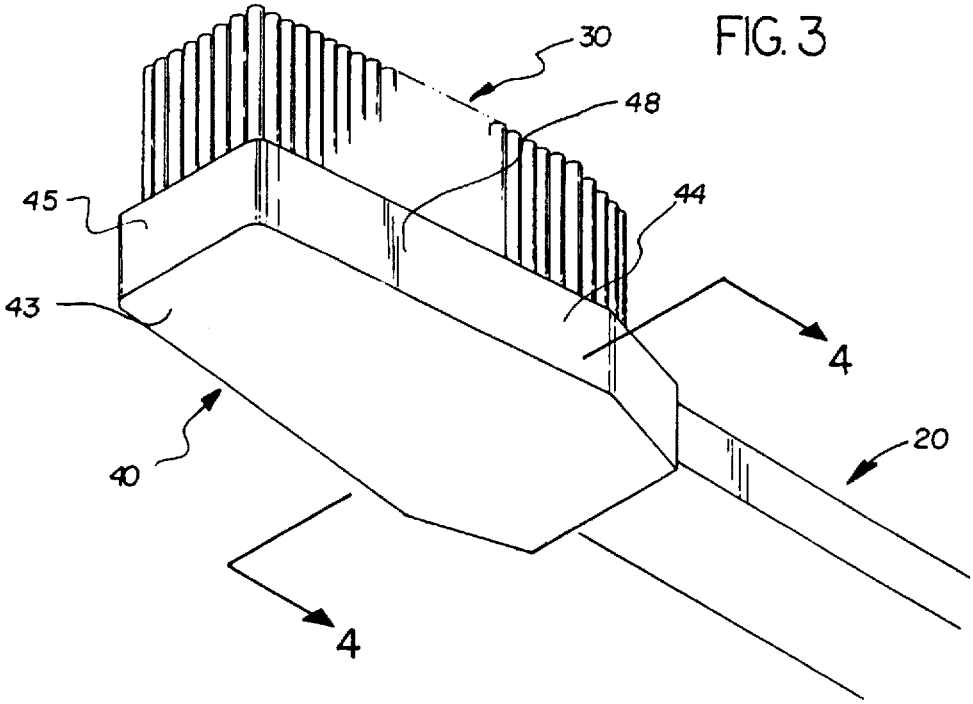
FIG. 3
FIG. 4
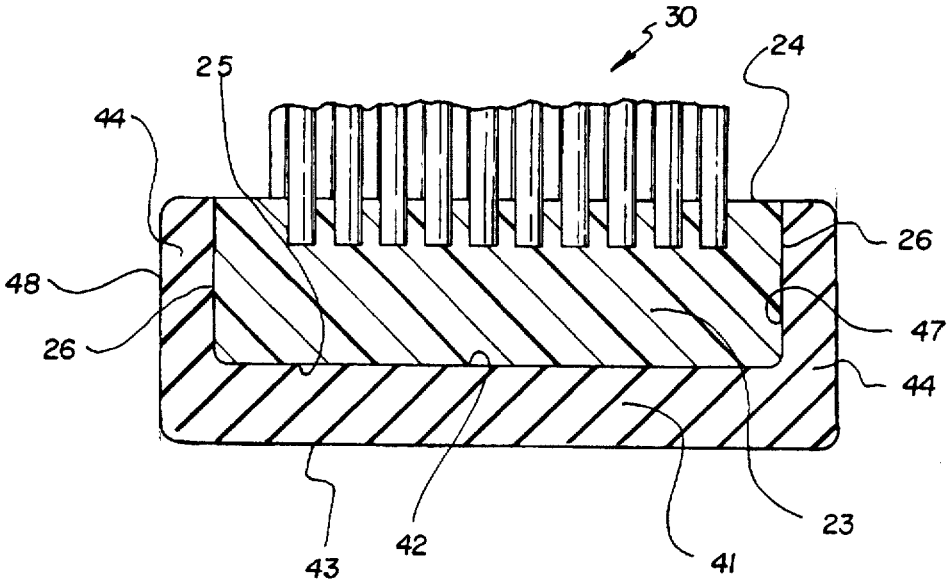

PADDED TOOTHBRUSH

BACKGROUND OF THE INVENTION

1. Field of the Invention

The present invention relates to toothbrushes and more particularly pertains to a new Padded Toothbrush for providing a safer and more comfortable toothbrush.

2. Description of the Prior Art

The use of toothbrushes is known in the prior art. More specifically, toothbrushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art toothbrushes include U.S. Pat. No. 4,757,570; U.S. Pat. No. 5,040,260; U.S. Pat. No. 4,428,091; U.S. Pat. No. 5,337,436; U.S. Pat. No. 5,392,482; and U.S. Pat. No. 3,939,522.

While these devices fulfill their respective, particular objectives and requirements, the aforementioned patents do not disclose a new Padded Toothbrush. The inventive device includes an elongated member including a handle at one end and a head at an opposite end, wherein a plurality of bristles protude upward from the head and a protective pad is disposed around the sides of the head and on the back of the head so as to protect a user's teeth, gums, and inner mouth from contact with the head while brushing.

In these respects, the Padded Toothbrush according to the present invention substantially departs from the conventional concepts and designs of the prior art, and in so doing provides an apparatus primarily for the purpose of providing a safer and more comfortable toothbrush.

SUMMARY OF THE INVENTION

In view of the foregoing disadvantages inherent in the known types of toothbrushes now present in the prior art, the present invention provides a new Padded Toothbrush construction wherein the same can be utilized for providing a safer and more comfortable toothbrush.

The general purpose of the present invention, which will be described subsequently in greater detail, is to provide a new Padded Toothbrush apparatus and method which has many of the advantages of the toothbrushes mentioned heretofore and many novel features that result in a new Padded Toothbrush which is not anticipated, rendered obvious, suggested, or even implied by any of the prior art toothbrushes, either alone or in any combination thereof.

To attain this, the present invention generally comprises an elongated member including a handle at one end and a head at an opposite end, wherein a plurality of bristles protrude upward from the head and a protective pad is disposed around the sides of the head and on the back of the head so as to protect a user's teeth, gums, and inner mouth from contact with the head while brushing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying, out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Padded Toothbrush apparatus and method which has many of the advantages of the toothbrushes mentioned heretofore and many novel features that result in a new Padded Toothbrush which is not anticipated, rendered obvious, suggested, or even implied by any of the prior art toothbrushes, either alone or in any combination thereof.

It is another object of the present invention to provide a new Padded Toothbrush which may be easily and efficiently manufactured and marketed.

It is a further object of the present invention to provide a new Padded Toothbrush which is of a durable and reliable construction.

An even further object of the present invention is to provide a new Padded Toothbrush which is susceptible of a low cost of manufacture with regard to both materials and labor, and which accordingly is then susceptible of low prices of sale to the consuming public, thereby making such Padded Toothbrush economically available to the buying public.

Still yet another object of the present invention is to provide a new Padded Toothbrush which provides in the apparatuses and methods of the prior art some of the advantages thereof, while simultaneously overcoming some of the disadvantages normally associated therewith.

Still another object of the present invention is to provide a new Padded Toothbrush for providing a safer and more comfortable toothbrush.

Yet another object of the present invention is to provide a new Padded Toothbrush which includes an elongated member including a handle at one end and a head at an opposite end, wherein a plurality of bristles protrude upward from the head and a protective pad is disposed around the sides of the head and on the back of the head so as to protect a user's teeth, gums, and inner mouth from contact with the head while brushing.

Still yet another object of the present invention is to provide a new Padded Toothbrush that protects against injury to a person's teeth, gums, and the inside of their mouth.

Even still another object of the present invention is to provide a new Padded Toothbrush that reduces the possibility of the head of the toothbrush from bruising or cutting the gums.

Even still another object of the present invention is to provide a new Padded Toothbrush that can be used by individuals having tender teeth, gums, or tender areas within their mouths.

Even still another object of the present invention is to provide a new Padded Toothbrush that can be used by children since they are uncoordinated when learning to brush their teeth and may continually hit their gums, which may cause discomfort.

Even still another object of the present invention is to provide a new Padded Toothbrush that can be used to buff and polish teeth.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a bottom view of the present invention.

FIG. 4 is a cross sectional view taken along line 4—4 of FIG. 3.

DESCRIPTION OF THE PREFERRED EMBODIMENT

Figure 1:
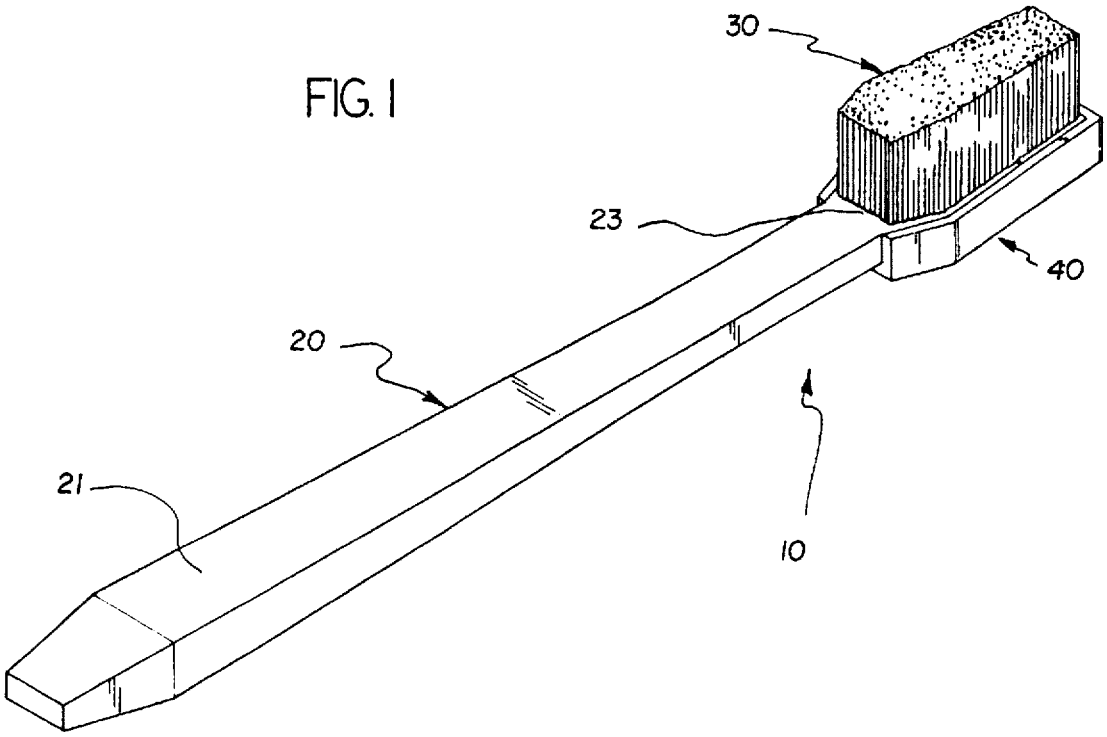
FIG. 1 is a perspective illustration of a new Padded Toothbrush according to the present invention.
Figure 2:
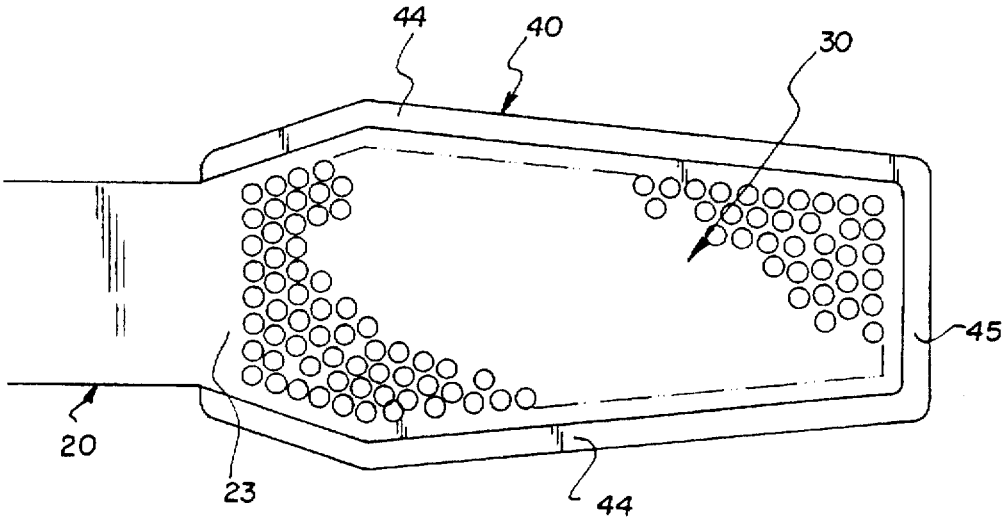
FIG. 2 is a top view of the present invention.
Figure 5:
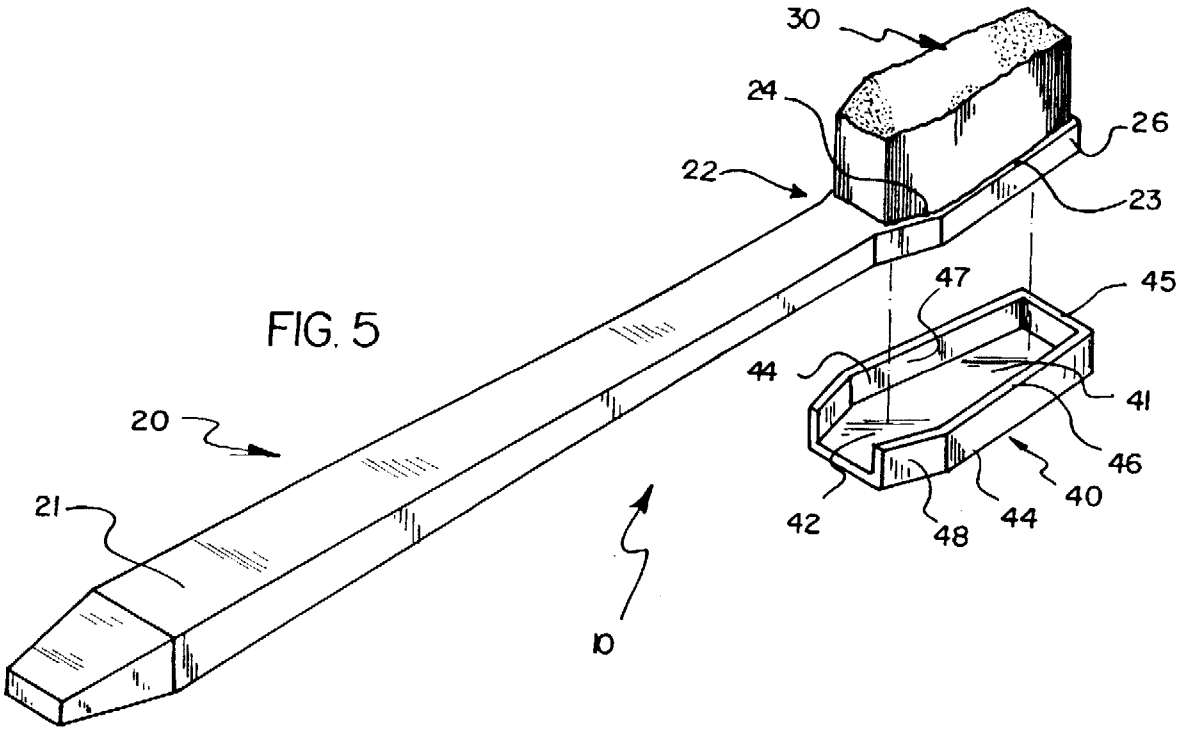
FIG. 5 is an exploded illustration of the present invention.

With reference now to the drawings, and in particular to FIGS. 1 through 5 thereof, a new Padded Toothbrush embodying the principles and concepts of the present invention and generally designated by the reference numeral 10 will be described.

More specifically, it will be noted that the Padded Toothbrush 10 comprises an elongated member 20 including a handle 21 at one end and a head 23 at an opposite end, wherein a plurality of bristles 30 protrude upward from the head 23 and a protective pad 40 is disposed around the sides of the head 23 and on the back of the head 23 so as to protect a user's teeth, gums, and inner mouth from contact with the head 23 while brushing.

As best illustrated in FIGS. 1 through 5, it can be shown that the head 23 of the toothbrush has a top surface 24, a bottom surface 25, a pair of lateral surfaces 26, and an end surface 27. The plurality of bristles 30 protrude upward from the top surface 24 of the head 23.

Preferably, the toothbrush has a neck 22 between the handle 21 and head 23. Ideally, the head and the neck have a uniform thickness, as does the outer perimeter of the head (see FIG. 5). Ideally, the head 23 has a broad portion proximate the neck and tapers to a narrower portion at a head distal end.

As best illustrated in FIGS. 1 through 5, it can be shown that the protective pad 40 comprises a planar base portion 41 having a top surface 42 and a bottom surface 43, a pair of lateral portions 44 extending upward from the top surface 42 of the planar base portion 41 along opposite sides thereof, and an end portion 45 extending upward from the top surface 42 of the planar base portion 41 at one end thereof. The pair of lateral portions 44 and the end portion 45 form a partial-perimeter wall 46 along three sides of the planar base portion 41. The partial-perimeter wall 46 has an inner surface 47 and an outer surface 48. The most preferred outer surface is substantially smooth (see FIG. 3). The protective pad 40 is disposed around the head 23 of the toothbrush 10 and conforms to a profile of the head 23 of the toothbrush 10 whereby the inner surface 47 of the partial-perimeter wall 46 abuts the pair of lateral surfaces 26 and the end surface 27 of the head 23 of the toothbrush 10 and whereby the top surface 42 of the planar base portion 41 abuts the bottom surface 25 of the head 23 of the toothbrush 10. The protective pad is most preferably fixedly attached to and extends outwardly from a full length of the pair of lateral surfaces 26 of the head 23. The protective pad 40 is formed of a compressible material that is soft and flexible.

In use, a user grasps the handle 21 of the toothbrush 10 and brushes their teeth with the plurality of bristles 30 protruding upward from the head 23 of the toothbrush 10. The protective pad 40 protects a user's teeth, gums, and inner mouth from contact with the head 23 while brushing. In addition to protecting a user's teeth, gums, and inner mouth while brushing, the protective pad 40 can be used for buffing and polishing teeth. As such, the bottom surface 43 of the planar base portion 41 of the protective pad 40 is positioned adjacent the teeth of a user thereof and agitated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A padded toothbrush comprising:

an elongated member including a handle at one end, a head at an opposite end and a neck between said handle and said head, said head having a top surface, a bottom surface, a pair of lateral surfaces, and an end surface, said head and said neck having a uniform thickness, said head further having a broad portion proximate said neck and tapering to a narrower portion at a head distal end;

a plurality of bristles protruding upward from said top surface of said head, said bristles being positioned proximate each other within an outer perimeter of said top surface of said head, said outer perimeter having a substantially uniform thickness; and a protective pad having a substantially smooth outer surface, said protective pad fixedly attached to and extending outwardly from a full length of said pair of lateral surfaces of said head, said end surface of said head, and said bottom surface of said head, said protective pad protecting a user's teeth, gums, and inner mouth from contact with said head while brushing;

wherein said protective pad comprises:

a planar base portion having a top surface and a bottom surface, a pair of lateral portions extending upward from said top surface of said planar base portion along opposite sides thereof, and an end portion extending upward from said top surface of said planar base portion at one end thereof, said pair of lateral portions and said end portion forming a partial-perimeter wall along three sides of said planar base portion, said partial-perimeter wall having an inner surface and an outer surface, said inner surface of said partial-perimeter wall abutting said pair of lateral surfaces of said head and said end surface of said head, said top surface of said planar base portion abutting said bottom surface of said head;

wherein said protective pad is formed of a compressible material; and wherein said compressible material is soft and flexible.

* * * * *